United States Patent [19]

Thoese et al.

[11] Patent Number: 4,457,997

[45] Date of Patent: Jul. 3, 1984

[54] TWO-COMPONENT DIAZOTYPE MATERIAL

[75] Inventors: Klaus Thoese; Hans-Dieter Frommeld; Siegfried Scheler, all of Wiesbaden, Fed. Rep. of Germany

[73] Assignee: Hoechst Aktiengesellschaft, Frankfurt am Main, Fed. Rep. of Germany

[21] Appl. No.: 337,277

[22] Filed: Jan. 5, 1982

[30] Foreign Application Priority Data

Jan. 10, 1981 [DE] Fed. Rep. of Germany ..... 3100579

[51] Int. Cl.[3] ..... G03C 1/54

[52] U.S. Cl. ..... 430/160; 430/157; 430/176; 430/909; 430/910; 430/911

[58] Field of Search ..... 430/157, 160, 176, 909, 430/910, 911

[56] References Cited

U.S. PATENT DOCUMENTS

| | | | |
|---|---|---|---|
| 2,405,523 | 8/1946 | Sease et al. . | |
| 2,990,281 | 6/1961 | Printy et al. | 430/274 |
| 3,252,800 | 5/1966 | Smith | 430/911 |
| 4,088,492 | 5/1978 | Pope et al. | 430/160 |
| 4,131,468 | 12/1978 | Rennison et al. | 96/75 |
| 4,171,222 | 10/1979 | Frommeld | 96/75 |

FOREIGN PATENT DOCUMENTS

| | | |
|---|---|---|
| 815956 | 7/1959 | United Kingdom . |
| 865680 | 2/1961 | United Kingdom . |
| 1072122 | 6/1967 | United Kingdom . |
| 1127076 | 9/1968 | United Kingdom . |
| 1169227 | 10/1969 | United Kingdom . |
| 1445699 | 8/1976 | United Kingdom . |

*Primary Examiner*—John E. Kittle
*Assistant Examiner*—Robert A. Wax
*Attorney, Agent, or Firm*—Schwartz, Jeffery, Schwaab, Mack, Blumenthal & Koch

[57] ABSTRACT

A two-component diazotype material, composed of a support and a light-sensitive layer which is applied thereto and contains a polymeric binder, a diazonium salt, a coupler, an acid stabilizer and conventional additives, wherein the support is a biaxially oriented polyester film and the polymeric binder comprises a mixture of about 10–60 percent by weight of a polymer or copolymer of vinyl acetate, for example, a copolymer of vinyl acetate and crotonic acid, and about 40–90 percent by weight of a cellulose ester, such as cellulose acetopropionate, cellulose acetobutyrate, cellulose propionate or cellulose butyrate.

7 Claims, No Drawings

TWO-COMPONENT DIAZOTYPE MATERIAL

BACKGROUND OF THE INVENTION

The present invention relates to a two-component diazotype material, composed of a support and a light-sensitive layer which is applied thereto and contains a polymeric binder, a diazonium salt, a coupler, an acid stabilizer and conventional additives.

It is known that cellulose esters are used as the polymeric binders in diazotype materials. Due to their good film-forming and optical properties, their heat stability and their good compatibility with diazonium salts and couplers, these esters have proved so advantageous that they are frequently quoted and used almost exclusively in practice. A disadvantage of these compounds is, however, an insufficient layer adhesion to polyester film, and this can be made adequate only with the assistance of suitable, additionally applied adhesive layers. Adhesive layers are applied, for example, in a special operation using trichloroacetic acid and silica or polyvinylidene chloride.

It is also known that polyvinyl acetate can be used as the binder (U.S. Pat. No. 2,405,523). Polyvinyl acetate has the advantage that its adhesion to polyester surfaces is somewhat better. As a thermoplastic, however, polyvinyl acetate has the great disadvantage that the sensitized layers have a strong tendency to become embossed and to stick during processing.

It is also known that copolymers of vinyl acetate and maleic acid or crotonic acid are distinguished by useful adhesion on polyester surfaces (German Auslegeschrift No. 1,065,724). These polymers can be applied from an aqueous-alkaline solution, but they are also detached again by aqueous alkali with equal ease. Moreover, these layers tend to stick.

The curing of adhesive layers or lacquer layers composed of a mixture of vinyl acetate/crotonic acid copolymers and, for example, urea/formaldehyde resins is also known (German Pat. No. 1,062,111 and German Auslegeschrift No. 1,461,260). In this way, their alkali solubility is reduced but not fully eliminated.

On the other hand, the more a lacquer layer has been cured, the more difficult it is to sensitize this layer, since during the diffusion process, the diazonium salts and the coupler penetrate into the layer to a lesser extent. Thus, the degree of curing of the layer is an additional important factor with regard to its suitability in diazo printing layers.

SUMMARY OF THE INVENTION

It is therefore an object of the present invention to provide an improved two-component diazotype material having a ligh-sensitive layer on polyester film.

Another object of the invention is to provide a two-component diazotype material wherein the light-sensitive layer on polyester film has excellent adhesion without tending to stick or to become embossed.

A further object of the invention is to provide such a diazotype material which can readily be sensitized and in which the other diazo printing properties are not adversely affected.

In accomplishing the foregoing objects, there has been provided in accordance with the present invention a two-component diazo-type material comprising a support comprising a biaxially oriented polyester film; and a light-sensitive layer which is applied to the support and comprises a polymeric binder, a diazonium salt, a coupler, and an acid stabilizer, wherein the polymeric binder comprises a mixture of from about 10 to 60 percent by weight of a polymer or copolymer of vinly acetate and from about 40 to 90 percent by weight of a cellulose ester. Preferably, an adhesive layer is applied to one or both surfaces of the polyester film.

Further objects, features and advantages of the present invention will become apparent from the detailed description of preferred embodiments which follows.

DETAILED DESCRIPTION OF PREFERRED EMBODIMENTS

The invention starts from a two-component diazotype material which is composed of a support and a light-sensitive layer which is applied thereto and contains a polymeric binder, a diazonium salt, a coupler, an acid stabilizer and conventional additives. In the two-component diazotype material of the invention, the support is a biaxially oriented polyester film and the polymeric binder comprises a mixture of from about 10–60 percent by weight of a polymer or copolymer of vinyl acetate and from about 40–90 percent by weight of a cellulose ester. Preferably, the copolymer comprises vinyl acetate and crotonic acid, wherein a crotonic acid content of about 4–12 percent by weight is particularly advantageous.

As a result, the layer adhesion, as compared with a cellulose ester or polyvinyl acetate as a binder by itself, is markedly improved, without the layers tending to stick or to become embossed. In addition, the lacquer layer can readily be sensitized, and the good diazo printing properties are preserved, such as storability of the unexposed material, developing speed, transparency and durability of full tone and copy background during storage of files.

According to the invention, the polymeric binder is a mixture of at least two substances: (1) polymers or copolymers of vinyl acetate, with those having a crotonic acid content of about 4–12 percent, corresponding to an acid number in the range of about 30–90, having proved very particularly suitable, and (2) cellulose esters, since these are particularly good film-formers. Esters of acetic acid, propionic acid or butyric acid, and mixed esters thereof, for example cellulose acetate-propionate, cellulose acetobutyrate or cellulose butyrate, are preferred.

The polyester films used as the support material are, for example, those composed of polybutylene terephthalate or of copolyesters, for example, those prepared from terephthalic acid, isophthalic acid and ethylene glycol or 1,4-dimethylglycol-cyclohexane, the isophthalic acid proportion being up to about 50 mole percent, or from terephthalic acid and ethylene glycol and polyethylene glycol having a molecular weight of from about 1,000 to 10,000, or from naphthalene-2,6-dicarboxylic acid, terephthalic acid and ethylene glycol. However, polyethylene terephthalate has proved especially suitable as the support material.

Those polyester films are preferred to which an adhesive layer has been applied during the preparation; as a rule, this is carried out between the first and second orientation steps. The application of an adhesion-promoter is described, for example, in German Auslegeschrift No. 1,629,480.

The diazonium compounds which can be used for the preparation of the light-sensitive layers are any of the numerous known diazonium salts available, for example, diazonium salts derived from substituted p-phenylenediamine or p-mercaptoaniline, for example, compounds of the formula

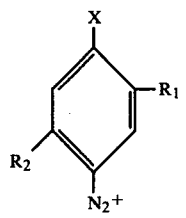

in which $R_1$ and/or $R_2$ can be hydrogen, chlorine, methyl, methoxy, ethoxy or butoxy and X can be a dimethylamino, diethylamino, dipropylamino, morpholino, pyrrolidino, piperidino, alkylmercapto or tolylmercapto group.

The diazonium salt is present in a known stabilized form, e.g., as a zinc chloride double salt, as a cadmium chloride double salt, tin chloride double salt, boron fluoride salt, or as a sulfate salt, hexafluorophosphate salt or the like.

The coupler substances to be used are also known. They are selected according to the desired color shade of the image areas. Examples which may be mentioned are couplers based on cyanoacetamide, acetoacetamide, phenol and phenolcarboxylic acid amide, naphthol, naphtholsulfonic acid amide and naphthoic acid amide, resorcinol derivatives and resorcylic acid derivatives, or those based on mono-, di-, tri- and tetra-hydroxy-di- and -triphenylene, which can also be substituted.

The light-sensitive layer can also contain the known stabilizers, such as, for example, 5-sulfo-salicylic acid, citric acid, maleic acid, tartaric acid, boric acid and also thiourea. It can also contain pigments, such as, for example, colloidal silica, finely ground alumina or silicates.

The examples which follow are intended to explain the invention in more detail, without restricting the scope of the invention thereto.

EXAMPLE 1

The following polymeric binder compositions are prepared:

| | | |
|---|---|---|
| A | 10 g | of cellulose acetopropionate (3.6% of acetyl groups, 44.7% of propionyl groups and 1.8% of hydroxyl groups (a 20% strength solution of this product in 72:8 acetone/ethanol has a viscosity of about 7 Pa · s)), |
| B | 10 g | of polyvinyl acetate having a molecular weight of $1 \times 10^6$, |
| C | 10 g | of a copolymer of vinyl acetate and crotonic acid, having an acid number of 35–45 and a molecular weight of $1 \times 10^5$ |
| D | 5 g | of a copolymer of vinyl acetate and crotonic acid (same as C) |
| | 5 g | of a butylated urea/formaldehyde resin and |
| | 0.2 g | of sulfosalicylic acid, |
| E | 7 g | of cellulose acetopropionate (same as A) and |
| | 3 g | of polyvinyl acetate (same as B), or |
| F | 5 g | of cellulose acetopropionate (same as A) and |
| | 5 g | of polyvinyl acetate (same as B) |

Each is dissolved in a mixture of
95 ml of acetone,
15 ml of methanol and
10 ml of methylglycol to produce individual lacquers and the lacquers A–F are coated on to 100 μm thick film of biaxially oriented polyethylene terephthalate, which film has been provided during production with an adhesive layer composed of an acrylate or methacrylate composition. Each film is then dried for 5 minutes at 70°–80° C., in such a way that lacquer films having a layer weight of 7–8 g/cm$^2$ are obtained. For curing, lacquer D is additionally dried for 5 minutes at about 150° C.

The lacquered films are then sensitized by dipping in a solution which contains the constituents which follow, and subsequently drying at 80° C.:

70 ml of water,
75 ml of formic acid,
1,000 ml of isopropanol,
10 g of 5-sulfosalicylic acid,
10 g of tartaric acid,
2 g of boric acid,
12.5 g of 2-hydroxynaphthoic acid N-2'-methylanilide and
15 g of p-dipropylaminobenzenediazonium tetrafluoroborate.

The dried samples are developed, in a commercially available diazo printing machine between filter paper, with moist ammonia at about 75° C. up to full tone, since adhesion defects become more readily visible on full tones. Layers which tend to stick or to become embossed then remain adhering to the paper surface. When the film is peeled off the paper, stuck or embossed paper fibers remain as blemishes on the lacquer layer.

To test the layer adhesion on the film base, the film side carrying the layer is scribed with a grid tester according to DIN 53,151. An adhesive tape is pressed onto the damaged layer, and this tape is then detached with a jerk. In the case of good layer adhesion on the film, no part of th layer may remain on the adhesive tape in this test. In the case of moderate layer adhesion, individual points of ruptures are visible and, if the layer adhesion is poor, the lacquer can be largely peeled off.

Adhesion is permanently impaired by storage in a humid atmosphere (96% relative atmospheric humidity, storage for 24 hours). A similar deterioration of adhesion can also be observed in a rapid test by storing under water for one hour.

The table which follows reproduces the results of the experiments with the sensitized layers:

| | Layer adhesion | | | |
|---|---|---|---|---|
| Sample | dry | after storage in water for 1 hour | Tendency to stick | Solubility in dilute ammonia |
| A | moderate | poor | no sticking | insoluble |
| B | good-moderate | good-moderate | sticks strongly | insoluble |
| C | good | | sticks strongly | readily soluble |
| D | good | | sticks strongly | soluble |
| E | good | good-moderate | no sticking | insoluble |
| F | good | good | no sticking | insoluble |

It is found that lacquers E and F have the best adhesion, do not show any signs of sticking and, in contrast to C and D, are not soluble when wiped over with a pad of cotton wool soaked with dilute ammonia (1:10).

EXAMPLE 2

Pigment lacquers based on 68 ml of acetone,
12 ml of methanol,
12 ml of methylglycol,
8 g of cellulose acetopropionate and
4 g of a mixture of finely particulate precipitated silica and alumina are coated, g without an additive,
H with 0.9 g (10%) of a copolymer of vinyl acetate and crotonic acid (acid number 90),
I with 1.5 g (16%) of a copolymer of vinyl acetate and crotonic acid (acid number 90),
K with 1.5 g (16%) of a copolymer of vinyl acetate and crotonic acid (acid number 45) or
L with 2.5 g (24%) of polyvinyl acetate having a molecular weight of $2.6\times10^5$, after dissolution onto a 100 μm thick film of biaxially oriented polyethylene terephthalate which, during production, has been provided with an adhesive layer. Each is dried for 5 minutes at 90° C., in such a way that layer weights of 7–8 g/m² are obtained. Subsequently, the lacquered films are coated with a solution of 100 ml of water,
900 ml of isopropanol,
60 ml of formic acid
30 g of 5-sulfosalicylic acid,
30 g of resorcinol and
32 g of 2,5-dibutoxy-4-morpholino-benzenediazonium tetrachlorozincate and are dried.

In a diazo printing machine, the samples are developed with warm, moist ammonia and, subsequently, the adhesion is tested as described in Example 1.

The results of the adhesion test are compiled in the table which follows:

| Film sample | Layer adhesion of the developed film layer | |
|---|---|---|
| | dry | after storage in water for 1 hour |
| G | good-moderate | poor |
| H | good | moderate |
| I | good | good-moderate |
| K | good | good-moderate |
| L | good | good-moderate |

The adhesion results show that the pigmented lacquer layers according to the invention have a markedly better adhesion than the lacquer layer of the comparsion sample.

EXAMPLE 3

| | | |
|---|---|---|
| M | 8 g | of cellulose acetopropionate (2.5% of acetyl groups; 46% of propionyl groups; 2.8% of hydroxyl groups; viscosity: 20 seconds according to ASTM D-817 (formula A) and D-1343), |
| N | 8 g | of a copolymer of vinyl acetate and 5% of crotonic acid, (same as under C in Example 1), |
| O | 8 g | of polyvinyl acetate having a molecular weight of $2.6\times10^5$ |
| P | 4 g | of cellulose acetopropionate, (same as under M), and |
| | 4 g | of a copolymer of vinyl acetate and crotonic acid (same as under N), or |
| Q | 4 g | of cellulose acetopropionate (same as under M), and |
| | 4 g | of polyvinyl acetate (same as under O), |

are dissolved in 80 ml of acetone and
20 ml of methanol.

Subsequently the following substances are dissolved in each of these batches:

0.2 g of 5-sulfosalicylic acid,
0.2 g of 2-hydroxyphenol hydroxyethyl ether,
0.4 g of bis-(methoxyethyl) phthalate,
0.4 g of 2,4-dihydroxybenzoic acid ethanolamide and
0.6 g of 4-(p-tolymercapto)-2,5-diethoxybenzenediazonium tetrafluoroborate.

100 g/m² of the solutions are applied to the subbed polyester film and are dried for 5 minutes at 80° C. The light-sensitive films are exposed under an image original and are then developed with ammonia. Copies having strong brown lines and a colorless background are obtained.

The adhesion is determined analogously to Example 1. The table which follows gives the results:

| Sample | Layer adhesion | | Tendency to stick |
|---|---|---|---|
| | dry | after storage in water for 1 hour | |
| M | moderate | poor | does not stick |
| N | good | poor | sticks strongly |
| O | good | poor | sticks strongly |
| P | good | good | does not stick |
| Q | good | good | does not stick |

The quality of copies P and Q is markedly better. Similar results are obtained when the lacquers M–Q are coated onto a polyester film from another manufacturer and are dried.

EXAMPLE 4

Solutions of

| | | |
|---|---|---|
| R | 3 g | of cellulose acetobutyrate (15.3% of acetyl groups; 37% butyryl groups; 1.5% of hydroxyl groups; viscosity: 55 m Pa · s, 15% strength in acetone at 25° C.) or |
| S | 1.5 g | of cellulose acetobutyrate (same as under R), and |
| | 1.5 g | of polyvinyl acetate (same as under O in Example 3), |

in 30 ml of methylglycol are coated onto 180 μm thick polyester film and are dried for 5 minutes at 120° C.

Subsequently, the films are sensitized and developed up to blue full tones, as described in Example 1. In the case of sample R, the blue lacquer layer is readily detached as a skin. By contrast, sample S shows markedly improved adhesion as compared with sample R.

What is claimed is:

1. A two-component diazotype material, comprising: a support comprising a biaxially oriented polyester film; and a light-sensitive layer which is applied to said support and comprises a polymeric binder, a diazonium salt, a coupler, and an acid stabilizer, wherein the polymeric binder comprises a mixture of from about 10 to 60 percent by weight of a copolymer of vinyl acetate and crotonic acid and from about 90–40 percent by weight of a cellulose ester selected from the group of cellulose acetopropionate, cellulose acetobutyrate, cellulose propionate and cellulose butyrate.

2. A diazotype material as claimed in 1, wherein the copolymer of vinyl acetate and crotonic acid contains from about 4 to 12 percent by weight of crotonic acid.

3. A diazotype material as claimed in claim 1, wherein the support comprises a polyethylene terephthalate film.

4. A diazotype material as claimed in claim 1 or 3, further comprising an adhesive layer applied to one or both surfaces of the polyester film.

5. A diazotype material as claimed in claim 1, wherein said cellulose ester comprises cellulose acetopropionate.

6. A diazotype material as claimed in claim 5, wherein said binder comprises equal parts by weight of said cellulose ester and said copolymer of vinyl acetate and crotonic acid.

7. A diazotype material as claimed in claim 1, wherein said copolymer has an acid number within the range of about 30 to 90.

* * * * *